United States Patent [19]

Frame et al.

[11] Patent Number: 5,064,525

[45] Date of Patent: Nov. 12, 1991

[54] COMBINED HYDROGENOLYSIS PULS OXIDATION PROCESS FOR SWEETENING A SOUR HYDROCARBON FRACTION

[75] Inventors: Robert R. Frame, Glenview; Jeffery C. Bricker, Buffalo Grove; Laurence O. Stine, Western Springs, all of Ill.

[73] Assignee: UOP, Des Plains, Ill.

[21] Appl. No.: 657,013

[22] Filed: Feb. 19, 1991

[51] Int. Cl.[5] ..... C10G 27/00; C10G 27/04

[52] U.S. Cl. ..... 208/193; 208/189; 208/192; 208/207

[58] Field of Search ..... 208/189, 192, 193

[56] References Cited

U.S. PATENT DOCUMENTS

| | | | |
|---|---|---|---|
| 2,740,747 | 4/1956 | Swelser et al. | 208/189 |
| 2,769,759 | 11/1956 | Annable et al. | 208/189 |
| 2,918,426 | 12/1959 | Quimerez et al. | 208/206 |
| 2,966,453 | 12/1960 | Gleim et al. | 208/206 |
| 3,252,892 | 5/1966 | Gleim | 208/206 |
| 3,980,582 | 9/1976 | Anderson et al. | 252/428 |
| 4,019,869 | 4/1977 | Morris | 23/288 R |
| 4,201,626 | 5/1980 | Asdigian | 196/14.52 |
| 4,290,913 | 9/1981 | Frame | 252/428 |
| 4,490,246 | 12/1984 | Verachtert | 208/206 |
| 4,491,565 | 1/1985 | Verachtert | 422/256 |
| 4,753,722 | 1/1988 | Binh et al. | 208/207 |
| 4,897,175 | 1/1990 | Bricker et al. | 208/12 |
| 4,908,122 | 3/1990 | Frame | 208/207 |
| 4,913,802 | 4/1990 | Bricker et al. | 208/207 |

*Primary Examiner*—Helane E. Myers

*Attorney, Agent, or Firm*—Thomas K. McBride; Eugene I. Snyder; Frank S. Molinaro

[57] ABSTRACT

This invention relates to a process for sweetening a sour hydrocarbon fraction. The process involves two steps. In one step the mercaptans in the sour hydrocarbon fraction are reacted with hydrogen in the presence of a selective hydrogenolysis catalyst to selectively hydrogenolyse the tertiary mercaptans. In another step, the mercaptans are oxidized by reacting them with an oxidizing agent in the presence of oxidation catalyst and a basic component. The selective hydrogenolysis step and the oxidation step may be carried out in any order, i.e., either hydrogenolysis first followed by oxidation or vice versa.

16 Claims, No Drawings

COMBINED HYDROGENOLYSIS PULS OXIDATION PROCESS FOR SWEETENING A SOUR HYDROCARBON FRACTION

BACKGROUND OF THE INVENTION

A sour hydrocarbon fraction is one that contains offensive sulfur compounds such as mercaptans and hydrogen sulfide. These hydrocarbon fractions are treated using a process commonly known as sweetening. Sweetening processes involve reacting the mercaptans in the sour hydrocarbon fraction with an oxidizing agent in the presence of an oxidation catalyst and an alkaline agent to oxidize the mercaptans to disulfide. The oxidizing agent is most often air. When the concentration of mercaptan sulfur in the hydrocarbon fraction is about 5 ppm or less, the hydrocarbon fraction is said to be sweet. Gasoline, including natural, straight run and cracked gasolines, is the most frequently treated sour hydrocarbon fraction. Other sour hydrocarbon fractions which can be treated include the normally gaseous petroleum fractions as well as naphtha, kerosene, jet fuel, fuel oil, and the like.

Another method of eliminating mercaptans contained in a sour hydrocarbon fraction is by use of hydrodesulfurization which is also well known in the art. However, hydrodesulfurization involves the use of large quantities of hydrogen which is both uneconomical and hydrogenates some of the desirable components contained in the hydrocarbon fraction. For these reasons hydrodesulfurization is not used to remove mercaptans from a sour hydrocarbon fraction.

Although mercaptan oxidation will usually sweeten a sour hydrocarbon fraction, there are occasions when adequate sweetening is not possible. The apparent reason for this is that the sour hydrocarbon fraction contains a high concentration of tertiary mercaptans which are extremely difficult to oxidize. By tertiary mercaptans is meant mercaptans in which the carbon attached to the mercaptan sulfur atom is also attached to three other carbons. If the concentration of mercaptans is still relatively high after the sweetening process, the value of the product will be lowered. Therefore, there is a need for a process which can economically remove the tertiary mercaptans contained in a sour hydrocarbon fraction.

Applicants have solved this problem by combining a mercaptan hydrogenolysis step with a mercaptan oxidation step. The hydrogenolysis step is a selective hydrogenolysis step which hydrogenolyses the tertiary mercaptans. The conditions used to selectively hydrogenolyse the hydrocarbon fraction are very mild compared to conventional hydrotreating conditions. For example, applicants' process uses only about 0.1 to about 100 cubic feet of hydrogen per barrel of hydrocarbon fraction versus 1,000 to 5,000 cubic feet per barrel required for hydrotreating. Further, the instant process is run with the hydrogen and hydrocarbon fraction in a single phase, i.e., liquid phase, whereas hydrotreating involves a liquid and a gaseous phase. Finally, the selective hydrogenolysis process does not alter the major components of the hydrocarbon fraction.

The other step in the process is an oxidation step where the mercaptans are oxidized to disulfides by contacting the hydrocarbon fraction with an oxidation catalyst. The hydrogenolysis step and oxidation step can be carried out in any order. That is, the hydrogenolysis step can be carried out before or after the oxidation step.

Although the prior art discloses hydrotreating and selective hydrogenolysis, there is no mention of a hydrogenolysis step in combination with an oxidation step to sweeten sour hydrocarbon fractions containing tertiary mercaptans. One reference dealing with selective hydrogenation is U.S. Pat. No. 4,897,175. The '175 patent discloses a selective hydrogenation process for removing color bodies and color body precursors from a hydrocarbon fraction. However, there is no hint nor suggestion in the '175 patent that this process could be used to hydrogenolyse tertiary mercaptans in a sour hydrocarbon fraction. Nor is there any suggestion that a selective hydrogenolysis process could be combined with a mercaptan oxidation step to sweeten a sour hydrocarbon fraction. It is applicants who have recognized the synergistic relationship of a selective hydrogenolysis step followed by an oxidation step to sweeten a sour hydrocarbon fraction.

SUMMARY OF THE INVENTION

This invention relates to a process for sweetening a sour hydrocarbon fraction. Accordingly, one broad embodiment of the invention is a process for sweetening a sour hydrocarbon fraction comprising:

(a) reacting mercaptans contained in the sour hydrocarbon fraction with hydrogen in the presence of a selective hydrogenolysis catalyst at hydrogenolysis conditions and for a time sufficient to selectively hydrogenolyse the tertiary mercaptans; and (b) reacting the mercaptans in the sour hydrocarbon fraction with an oxidizing agent in the presence of a basic component and an oxidation catalyst effective in oxidizing the mercaptans to disulfides;

the steps (a) and (b) carried out in any order to produce a sweetened hydrocarbon fraction.

In still a further embodiment, the oxidation process is additionally carried out in the presence of an onium compound.

Another embodiment of the invention is a process for sweetening a sour hydrocarbon fraction where the hydrogenolysis step is carried out before the oxidation step.

Yet another embodiment of the invention is a process for sweetening a sour hydrocarbon fraction where the oxidation step is carried out before the hydrogenolysis step.

These and other objects and embodiments will become more apparent after a more detailed description of the invention.

DETAILED DESCRIPTION OF THE INVENTION

As stated, this invention relates to a process for sweetening a sour hydrocarbon fraction. The types of hydrocarbon fractions which may be treated using this process generally have a boiling point in the range of about 40° to about 325° C. Specific examples of these fractions are kerosene, straight run gasoline, straight run naphtas, heavy gas oils, jet fuels, diesel fuel, cracked gasoline and lubricating oils.

One necessary step in the instant process is to contact the sour hydrocarbon fraction with a selective hydrogenolysis catalyst. By a selective hydrogenolysis catalyst is meant one that will hydrogenolyse the mercaptans, especially the tertiary mercaptans, without hydrogenolysing or hydrogenating other components in the sour hydrocarbon fraction. The selective hydrogenolysis catalyst may be selected from well known selective hydrogenolysis catalysts. Common selective hydrogenolysis catalysts comprise at least one metal selected from the group consisting of a Group VIII metal, a Group VIB metal and mixtures thereof dispersed on a porous support. The Group VIII metals are iron, cobalt, nickel, ruthenium, rhodium, palladium, osmium, iridium and platinum, while the Group VIB metals are chromium, molybdenum and tungsten. Preferred metals include ruthenium, platinum, iron, palladium and nickel with nickel being especially preferred. Preferred catalysts which contain more than one metal are cobalt-/molybdenum, nickel/molybdenum and nickel/tungsten.

The porous support on which the desired metal is dispersed may be selected from the group consisting of aluminas, silica, carbon, alumina-silicates, natural and synthetic molecular sieves, synthetic and natural clays, alkaline earth oxides, e.g., CaO, MgO, etc. and mixtures thereof, with aluminas, molecular sieves and clays being preferred. Illustrative of the clays which can be used are smectite, bentonite, vermiculite, attapulgite, kaolinite, montmorillonite, hectorite, chlorite and beidellite. Of these, a preferred group of clays is attapulgite, bentonite, kaolinite and montmorillonite. Illustrative of the molecular sieves which can be used are zeolite Y, zeolite mordenite, zeolite L and zeolite ZSM-5. A preferred support is a mixture of alumina and clay with an especially preferred support being alumina and attapulgite clay. If an alumina/clay mixture is used, it is preferred that the clay be present in an amount from about 2 to about 60 weight percent. The porous support should have a surface area of about 3 to about 1200 $m^2/g$ and preferably from about 100 to about 1,000 $m^2/g$ and a pore volume of about 0.1 to about 1.5 cc/g, and preferably from about 0.3 to about 1.0 cc/g. The porous support may be formed in any shape which exposes the metal to the hydrocarbon fraction. Particulate shape is usually used for convenience. In particular, the support may be in the shape of pellets, spheres, extrudates, irregular shaped granules, etc.

The metals may be dispersed on the porous support in any manner well known in the art such as impregnation with a solution of a metal compound. The solution may be an aqueous solution or an organic solvent may be used, with an aqueous solution being preferred. Illustrative of the metal compounds which may be used to disperse the desired metals are chloroplatinic acid, ammonium chloroplatinate, hydroxy disulfite platinum (II) acid, bromoplatinic acid, platinum tetrachloride hydrate, dinitrodiamino platinum, sodium tetranitroplatinate, ruthenium tetrachloride, ruthenium nitrosyl chloride, hexachlororuthenate, hexaammineruthenium chloride, iron chloride, iron nitrate, palladium sulfate, palladium acetate, chloropalladic acid, palladium chloride, palladium nitrate, diamminepalladium hydroxide, tetraamminepalladium chloride, nickel chloride, nickel nitrate, nickel acetate, nickel sulfate, cobalt chloride, cobalt nitrate, cobalt acetate, rhodium trichloride, hexaaminerhodium chloride, rhodium carbonylchloride, rhodium nitrate, hexachloroiridate (IV) acid, hexachloroiridate (III) acid, ammonium hexachloroiridate (III), ammonium aquohexachloroiridate (IV), tetraamminedichloroiridate (III) chloride, osmium trichloride, molybdic acid, tungstic acid, chromic acid, nickel molybdate, nickel tungstate and cobalt molybdate.

The metal compound may be impregnated onto the support by techniques well known in the art such as dipping the support in a solution of the metal compound or spraying the solution onto the support. One preferred method of preparation involves the use of a steam jacketed rotary dryer. The support is immersed in the impregnating solution contained in the dryer and the support is tumbled therein by the rotating motion of the dryer. Evaporation of the solution in contact with the tumbling support is expedited by applying steam to the dryer jacket. Regardless of how the impregnation is carried out, the impregnated support is dried and then heated at a temperature of about 200° to about 450° C. in a nitrogen/10% steam atmosphere for a period of time of about 1 to about 3 hours. If more than one metal is to be dispersed on the support, the metals may be impregnated sequentially in any order or they may be simultaneously impregnated from a common solution.

The amount of metal dispersed on the support may vary considerably but generally an amount from about 0.01 to about 20.0 weight percent of the support is adequate to effect the treatment. Specifically, when the desired metal is platinum or ruthenium, the amount present is conveniently selected to be from about 0.1 to about 5 weight percent. When the metal is nickel a preferred concentration is from about 0.5 to about 15 weight percent. Finally, when more than one metal is desired, the total metal concentration is from about 0.1 to about 40 weight percent. If two metals are desired and one metal is a Group VIII metal and the other metal is a Group VIB metal, the ratio of Group VIII to Group VIB metal varies from about 0.01 to about 1.0.

A particularly preferred selective hydrogenolysis catalyst is a sulfided Group VIII metal dispersed on a porous support. The sulfided metal catalyst may be prepared in a number of ways well known in the art. For example, after the metal has been dispersed onto the support, the resultant catalyst can be sulfided by contacting the catalyst with a sulfur containing compound such as hydrogen sulfide, carbon disulfide, mercaptans, disulfides, etc. The conditions under which the catalyst is sulfided include a temperature of about 20° to about 200° C., and a pressure from atmospheric to about 200 psig. The sulfiding may be carried out either in a batch mode or a continuous mode with a continuous mode being preferred. One method of sulfiding a catalyst is to place the catalyst in a reactor and flow a gas stream over the catalyst at a temperature of about 20° to about 200° C. at a pressure from atmospheric to about 200 psig and a gas hourly space velocity of about 500 to about 5000 $hr^{-1}$. The gas stream contains from about 0.1 to about 3% hydrogen sulfide with the remainder of the gas stream being composed of nitrogen, hydrogen, natural gas, methane, carbon dioxide or mixtures thereof. The total amount of sulfur which is deposited on the metal catalyst can vary substantially but is conveniently chosen to be from about 0.001 to about 5 weight percent of the catalyst and preferably from about 0.01 to about 2 weight percent. The amount of sulfur deposited on the catalyst is determined by the amount of metal dispersed on the catalyst since the sulfur sulfides the surface of the metal. Thus, higher concentrations of sulfur are required for the higher metal concentrations.

Another method of sulfiding the catalyst involves adding the sulfur in situ during the hydrogenolysis process. This method involves adding a sulfur containing compound such as those enumerated above to the hydrocarbon fraction prior to contact with the catalyst.

The addition may be done continuously or intermittently. When done continuously the concentration of the sulfur containing compound should be from about 1 to about 50 ppm (on a sulfur basis) and preferably from about 5 to about 25 wppm, whereas when the addition is done intermittently the concentration should be from about 100 to about 5000 wppm and preferably from about 500 to about 2500 wppm. It should be noted that the mercaptans present in the sour hydrocarbon fraction are capable of sulfiding the catalyst.

The hydrocarbon fraction is contacted with the selective hydrogenolysis catalyst in the presence of hydrogen. The hydrogen reacts primarily with the tertiary mercaptans, and hydrogenolyses them to hydrogen sulfide and hydrocarbons. The mercaptans which are contained in the sour hydrocarbon are primary, secondary or tertiary mercaptans. The reaction conditions used will hydrogenolyse the tertiary mercaptans without substantially hydrogenolysing the primary and secondary mercaptans. Additionally, since the hydrogenolysis conditions are so mild, the aromatic components are not substantially affected.

The conditions under which the selective hydrogenolysis takes place are as follows. First, it is necessary to contact the hydrocarbon fraction with the catalyst in the presence of hydrogen at elevated temperatures. For convenience, the temperature range may be chosen to be from about 25° to about 300° C. and preferably from about 35° to about 220° C. The process may be carried out at atmospheric pressure although greater than atmospheric pressure is preferred. Thus, a pressure in the range of about 16 to about 2000 psig (110 to 13,788 kPa) may be used with pressures of 100 to about 1000 psig (689 to 6,894 kPa) being preferred. Finally, the amount of hydrogen which is added to the hydrocarbon fraction varies from about 0.1 to about 10 mole percent based on the total mercaptan sulfur content and preferably from about 0.25 to about 2 mole percent. At the conditions stated for the process, the small amount of hydrogen which is added to the hydrocarbon fraction is substantially and in some cases completely dissolved in the hydrocarbon fraction.

The process may be operated either in a continuous mode or in a batch mode. If a continuous mode is used a liquid hourly space velocity between about 0.1 and about 40 $hr^{-1}$, and preferably from about 0.5 to about 20 $hr^{-1}$ should be used to provide sufficient time for the hydrogen and unsaturated hydrocarbons to react. If a batch process is used, the hydrocarbon fraction, catalyst and hydrogen should be in contact for a time from about 0.1 to about 25 hrs.

It should be emphasized that the instant process is run with the hydrocarbon fraction substantially in the liquid phase. Thus, only enough pressure is applied to substantially dissolve the hydrogen into the hydrocarbon fraction and to maintain the hydrocarbon fraction in the liquid phase. This is in contrast to a conventional hydrotreating process where the hydrogen is substantially in the gas phase.

Another necessary step in the instant sweetening process is an oxidation step where the primary and secondary mercaptans are oxidized to disulfides. Generally, this step involves contacting the sour hydrocarbon fraction with an oxidation catalyst, a basic component and an onium compound in the presence of an oxidizing agent.

The oxidation catalyst which is employed is a metal chelate dispersed on an adsorbent support. The adsorbent support which may be used in the practice of this invention can be any of the well known adsorbent materials generally utilized as a catalyst support or carrier material. Preferred adsorbent materials include the various charcoals produced by the destructive distillation of wood, peat, lignite, nutshells, bones, and other carbonaceous matter, and preferably such charcoals as have been heat-treated or chemically treated or both, to form a highly porous particle structure of increased adsorbent capacity, and generally defined as activated carbon or charcoal. Said adsorbent materials also include the naturally occurring clays and silicates, e.g., diatomaceous earth, fuller's earth, kieselguhr, attapulgus clay, feldspar, montmorillonite, halloysite, kaolin, and the like, and also the naturally occurring or synthetically prepared refractory inorganic oxides such as alumina, silica, zirconia, thoria, boria, etc., or combinations thereof like silica-alumina, silica-zirconia, alumina-zirconia, etc. Any particular solid adsorbent material is selected with regard to its stability under conditions of its intended use. For example, in the treatment of a sour petroleum distillate, the adsorbent support should be insoluble in, and otherwise inert to, the hydrocarbon fraction at the alkaline reaction conditions existing in the treating zone. Charcoal, and particularly activated charcoal, is preferred because of its capacity for metal chelates, and because of its stability under treating conditions.

Another necessary component of the oxidation catalyst used in this invention is a metal chelate which is dispersed on an adsorptive support. The metal chelate employed in the practice of this invention can be any of the various metal chelates known to the art as effective in catalyzing the oxidation of mercaptans contained in a sour petroleum distillate, to disulfides or polysulfides. The metal chelates include the metal compounds of tetrapyridinoporphyrazine described in U.S. Pat. No. 3,980,582, e.g., cobalt tetrapyridinoporphyrazine; porphyrin and metaloporphyrin catalysts as described in U.S. Pat. No. 2,966,453, e.g., cobalt tetraphenylporphyrin sulfonate; corrinoid catalysts as described in U.S. Pat. No. 3,252,892, e.g., cobalt corrin sulfonate; chelate organometallic catalysts such as described in U.S. Pat. No. 2,918,426, e.g., the condensation product of an aminophenol and a metal of Group VIII; the metal phthalocyanines as described in U.S. Pat. No. 4,290,913, etc. As stated in U.S. Pat. No. 4,290,913, metal phthalocyanines are a preferred class of metal chelates. All of the above cited U.S. patents are incorporated by reference.

The metal phthalocyanines which can be employed to catalyze the oxidation of mercaptans generally include magnesium phthalocyanine, titanium phthalocyanine, hafnium phthalocyanine, vanadium phthalocyanine, tantalum phthalocyanine, molybdenum phthalocyanine, manganese phthalocyanine, iron phthalocyanine, cobalt phthalocyanine, platinum phthalocyanine, palladium phthalocyanine, copper phthalocyanine, silver phthalocyanine, zinc phthalocyanine, tin phthalocyanine, and the like. Cobalt phthalocyanine and vanadium phthalocyanine are particularly preferred. The ring substituted metal phthalocyanines are generally employed in preference to the unsubstituted metal phthalocyanine (see U.S. Pat. No. 4,290,913), with the sulfonated metal phthalocyanine being especially preferred, e.g., cobalt phthalocyanine monosulfate, cobalt phthalocyanine disulfonate, etc. The sulfonated derivatives may be prepared, for example, by reacting cobalt, vanadium or other metal phthalocyanine with fuming sulfuric acid. While the sulfonated derivatives are preferred, it is understood that other derivatives, particularly the carboxylated derivatives, may be employed. The carboxylated derivatives are readily prepared by the action of trichloroacetic acid on the metal phthalocyanine. The concentration of metal chelate and metal phthalocyanine can vary from about 0.1 to about 2000 ppm and preferably from about 50 to about 800 ppm.

An optional component of the catalyst is an onium compound. An onium compound is an ionic compound in which the positively charged (cationic) atom is a nonmetallic element other than carbon and which is not bonded to hydrogen. The onium compounds which can be used in this invention are selected from the group consisting of quaternary ammonium, phosphonium, arsonium, stibonium, oxonium and sulfonium compounds, i.e., the cationic atom is nitrogen, phosphorus, arsenic, antimony, oxygen and sulfur, respectively. Table 1 presents the general formula of these onium compounds, and the cationic element. The use of onium compounds is described in U.S. Pat. No. 4,897,180 which is incorporated by reference.

TABLE 1

Name and Formula of Onium Compounds

| Formula* | Name | Cationic Element |
|---|---|---|
| $R_4N^+$ | quaternary ammonium | nitrogen |
| $R_4P^+$ | phosphonium | phosphorous |
| $R_4As^+$ | arsonium | arsenic |
| $R_4Sb^+$ | stibonium | antimony |
| $R_3O^+$ | oxonium | oxygen |
| $R_3S^+$ | sulfonium | sulfur |

*R is a hydrocarbon radical.

For the practice of this invention it is desirable that the onium compounds have the formula $$[R'R''R_yM]^+X^-$$

where R is a hydrocarbon group containing up to about 20 carbon atoms and selected from the group consisting of alkyl, cycloalkyl, aryl, alkaryl, and aralkyl, R' is a straight chain alkyl group containing from about 5 to about 20 carbon atoms, R'' is a hydrocarbon group selected from the group consisting of aryl, alkaryl and aralkyl, M is nitrogen, phosphorus, arsenic, antimony, oxygen or sulfur, and X is an anion selected from the group consisting of halide, hydroxide, nitrate, sulfate, phosphate, acetate, citrate and tartrate, and y is 1 when M is oxygen or sulfur and y is 2 when M is phosphorus, arsenic, antimony or nitrogen.

Illustrative examples of onium compounds which can be used to practice this invention, but which are not intended to limit the scope of this invention are: benzyldimethylhexadecylphosphonium chloride, benzyldiethyldodecylphosphonium chloride, phenyldimethyldecylphosphonium chloride, trimethyldodecylphosphonium chloride, naphthyldipropylhexadecyl phosphonium chloride, benzyldibutyldecylphosphonium chloride, benzyldimethylhexadecylphosphonium hydroxide, trimethyldodecylphosphonium hydroxide, naphthyldimethylhexadecylphosphonium hydroxide, tributylhexadecylphosphonium chloride, benzylmethylhexadecyloxonium chloride, benzylmethylhexadecyloxonium chloride, naphthylpropyldecyloxonium hydroxide, dibutyldodecyloxonium chloride, phenylmethyldodecyloxonium chloride, phenylmethyldodecyloxonium chloride, dipropylhexadecyloxonium chloride, dibutylhexadecyloxonium hydroxide, benzylmethylhexadecylsulfonium chloride, diethyldodecylsulfonium chloride, naphthylpropylhexadecylsulfonium hydroxide, benzylbutyldodecylsulfonium chloride, phenylmethylhexadecylsulfonium chloride, dimethylhexadecylsulfonium chloride, benzylbutyldodecylsulfonium hydroxide, benzyldiethyldodecylarsonium chloride, benzyldiethyldodecylstibonium chloride, trimethyldodecylarsonium chloride, trimethyldodecylstibonium chloride, benzyldibutyldecylarsonium chloride, benzyldibutyldecylstibonium chloride, tributylhexadecylarsonium chloride, tributylhexadecylstibonium chloride, naphthylpropyldecylarsonium hydroxide, naphthylpropyldecylstibonium hydroxide, benzylmethylhexadecylarsonium chloride, benzylmethylhexadecylstibonium chloride, benzylbutyldodecylarsonium hydroxide, benzlbutyldodecylstibonium hydroxide, benzyldimethyldodecylammonium hydroxide, benzyldimethyltetradecylammonium hydroxide, benzyldimethylhexadecylammonium hydroxide, benzyldimethyloctadecylammonium hydroxide, dimethylcyclohexyloctylammonium hydroxide, diethylcyclohexyloctylammonium hydroxide, dipropylcyclohexyloctylammonium hydroxide, dimethylcyclohexyldecylammonium hydroxide, diethylcyclohexyldecylammonium hydroxide, dipropylcyclohexyldecylammonium hydroxide, dimethylcyclohexyldodecylammonium hydroxide, diethylcyclohexyldodecylammonium hydroxide, dipropylcyclohexyldodecylammonium hydroxide, dimethylcyclohexyltetradecylammonium hydroxide, diethylcyclohexyltetradecylammonium hydroxide, dipropylcyclohexyltetradecylammonium hydroxide, dimethylcyclohexylhexadecylammonium hydroxide, diethylcyclohexylhexadecylammonium hydroxide, dipropylcyclohexylhexadecylammonium hydroxide, dimethylcyclohexyloctadecylammonium hydroxide, diethylcyclohexyloctadecylammonium hydroxide, dipropylcyclohexyloctadecylammonium hydroxide, as well as the corresponding fluoride, chloride, bromide, iodide, sulfate, nitrate, nitrite, phosphate, acetate, citrate and tartrate compounds.

The metal chelate component and optional onium compound can be dispersed on the adsorbent support in any conventional or otherwise convenient manner. The components can be dispersed on the support simultaneously from a common aqueous or alcoholic solution and/or dispersion thereof or separately and in any desired sequence. The dispersion process can be effected utilizing conventional techniques whereby the support in the form of spheres, pills, pellets, granules or other particles of uniform or irregular size or shape, is soaked, suspended, dipped one or more times, or otherwise immersed in an aqueous or alcoholic solution and/or dispersion to disperse a given quantity of the alkali metal hydroxide, onium compound and metal chelate components. Typically, the onium compound will be present in a concentration of about 0.1 to about 10 weight percent of the composite. In general, the amount of metal phthalocyanine which can be adsorbed on the solid adsorbent support and still form a stable catalytic composite is up to about 25 weight percent of the composite. A lesser amount in the range of from about 0.1 to about 10 weight percent of the composite generally forms a suitably active catalytic composite.

One preferred method of preparation involves the use of a steam-jacketed rotary dryer. The adsorbent support is immersed in the impregnating solution and/or dispersion containing the desired components contained in the dryer and the support is tumbled therein by the rotating motion of the dryer. Evaporation of the solution in contact with the tumbling support is expedited by applying steam to the dryer jacket. In any case, the resulting composite is allowed to dry under ambient temperature conditions, or dried at an elevated temperature in an oven, or in a flow of hot gases, or in any other suitable manner.

An alternative and convenient method for dispersing the metal chelate and optional onium compound on the solid adsorbent support comprises predisposing the support in a sour hydrocarbon fraction treating zone or chamber as a fixed bed and passing a metal chelate and optional onium compound solution and/or dispersion through the bed in order to form the catalytic composite in situ. This method allows the solution and/or dispersion to be recycled one or more times to achieve a desired concentration of the metal chelate and optional onium compound on the adsorbent support. In still another alternative method, the adsorbent may be predisposed in said treating zone or chamber, and the zone or chamber thereafter filled with the solution and/or dispersion to soak the support for a predetermined period.

Another feature of this step of the invention is that the hydrocarbon fraction be contacted with an aqueous solution containing a basic component and optionally an onium compound (as described above). The basic component is an alkali metal hydroxide, ammonium hydroxide or mixtures thereof. Preferred alkali metal hydroxides are sodium and potassium hydroxide. The use of ammonium hydroxide is disclosed in U.S. Pat. Nos. 4,908,122 and 4,913,802 which are incorporated by reference. It is preferred to use ammonium hydroxide as the basic component. The concentration of the basic component can vary considerably from about 0.1 to about 20 weight percent. Although the oxidation of the mercaptans can be carried out by the use of a basic component and a metal chelate catalyst, it is preferred that an onium compound be present in the basic solution. The concentration of onium compound can vary from about 0.01 to about 50 weight percent. The aqueous solution may further contain a solubilizer to promote mercaptan solubility, e.g., alcohols and especially methanol, ethanol, n-propanol, isopropanol, etc. The solubilizer, when employed, is preferably methanol, and the aqueous solution may suitably contain from about 2 to about 10 volume percent thereof.

The treating conditions which may be used to carry out the present invention are those that have been disclosed in the prior art treating conditions. Typically, the hydrogenolysed hydrocarbon fraction is contacted with the oxidation catalyst which is in the form of a fixed bed. The process is usually effected at ambient temperature conditions, although higher temperatures up to about 105° C. are suitably employed. Pressures of up to about 1,000 psi or more are operable although atmospheric or substantially atmospheric pressures are suitable. Contact times equivalent to a liquid hourly space velocity of from about 0.5 to about 10 or more are effective to achieve a desired reduction in the mercaptan content of the hydrogenolysed hydrocarbon fraction, an optimum contact time being dependent on the size of the treating zone, the quantity of catalyst contained therein, and the character of the fraction being treated.

As previously stated, sweetening of the sour hydrocarbon fraction is effected by oxidizing the mercaptans to disulfides. Accordingly, the process is effected in the presence of an oxidizing agent, preferably air, although oxygen or other oxygen-containing gases may be employed. In fixed bed treating operations, the sour hydrocarbon fraction may be passed upwardly or downwardly through the catalytic composite. The sour hydrocarbon fraction may contain sufficient entrained air, but generally added air is admixed with the fraction and charged to the treating zone concurrently therewith. In some cases, it may be advantageous to charge the air separately to the treating zone and countercurrent to the fraction separately charged thereto. Examples of specific arrangements to carry out the treating process may be found in U.S. Pat. Nos. 4,490,246 and 4,753,722 which are incorporated by reference.

Instead of dispersing the metal chelate onto a solid support, the metal chelate may be dissolved in an aqueous solution which contains the basic component. When the metal chelate is dissolved in the aqueous solution, the process is referred to as a liquid-liquid process. If a liquid-liquid process is used the optional onium compounds described above may also be used to increase activity and/or durability.

Methods of effecting liquid-liquid oxidation are well known in the art and may be carried out in a batch or continuous mode. In a batch process the sour hydrocarbon fraction is introduced into a reaction zone containing the aqueous solution which contains the metal chelate, the basic component and optional onium compound. Air is introduced therein or passed therethrough. Preferably the reaction zone is equipped with suitable stirrers or other mixing devices to obtain intimate mixing. In a continuous process the aqueous solution containing the metal chelate basic component and optional onium compound is passed countercurrently or concurrently with the sour hydrocarbon fraction in the presence of a continuous stream of air. In a mixed type process, the reaction zone contains the aqueous solution, metal chelate basic component and optional onium compound, and hydrocarbon fraction and air are continuously passed therethrough and removed generally from the upper portion of the reaction zone. For specific examples of apparatus used to carry out a liquid/-liquid process, see U.S. Pat. Nos. 4,019,869, 4,201,626 and 4,491,565 and 4,753,722 which are incorporated by reference.

The hydrogenolysis and oxidation steps can be carried out in any order. Thus, a sour hydrocarbon fraction can be flowed to a hydrogenolysis zone where the tertiary mercaptans are selectively hydrogenolysed and then the partially treated hydrocarbon fraction is flowed to an oxidation zone where the remaining mercaptans, i.e., primary and secondary mercaptans, are oxidized to provide a sweetened product. The steps can also be carried out in the reverse order. That is, a sour hydrocarbon fraction is first flowed to an oxidation zone where the primary and secondary mercaptans (and some tertiary mercaptans) are oxidized as described above and then this partially sweetened hydrocarbon fraction is flowed to a hydrogenolysis zone where the tertiary mercaptans are selectively hydrogenolysed. Although the two steps can be carried out in any order, it is preferred that the selective hydrogenolysis step be carried out first, followed by the oxidation step.

The following examples are presented in illustration of this invention and are not intended as undue limitations on the generally broad scope of the invention as set out in the appended claims.

EXAMPLE 1

A kerosine with 413 ppm mercaptan sulfur, no hydrogen sulfide and an APHA of 110 was treated in several ways as follows. First, a reactor was set up to continuously treat the kerosine as follows. The kerosine and hydrogen were fed into a feed charger. The hydrogen pressure on the charger was 80 psig which allowed part of the hydrogen (about 0.22 mole percent of the kerosine feed) to dissolve in the kerosine. The kerosine containing hydrogen was then fed to the reactor (under 100 psig pressure) which contained 10 cc of catalyst. The reactor temperature was raised to 190° C. and the kerosine was downflowed over the catalyst for a portion of the time at a liquid hourly space velocity (LHSV) of 3 $hr^{-1}$ and for a portion of the time, at a LHSV of 12 $hr^{-1}$.

The catalyst consisted of a support which was a mixture of alumina (obtained from Catapal) and attapulgite clay (85:15 weight percent ratio) having dispersed thereon 10 weight percent nickel. The catalyst was prepared by placing into a rotary evaporator 50 grams of the alumina/clay support which was in the shape of 35 to 100 mesh granules. To this support there was added an aqueous nickel nitrate solution containing sufficient nickel to result in 10 weight percent nickel on the support.

The impregnated support was first rolled in the rotary evaporator for 15 minutes. After this time the evaporator was heated with steam for about 2 hours. Next the impregnated support was dried in an oven for about 2 hours and then heated to 400° C. under a nitrogen atmosphere, held there for 1 hour in the presence of 10% steam/nitrogen and for 30 minutes in the absence of steam, then cooled down to room temperature in nitrogen. After the catalyst was calcined, it was sulfided in a batch process by placing the catalyst in a container, filling the container with a 10% $H_2S$/90% $N_2$ gas mixture, tightly closing the container and then letting the mixture equilibrate at room temperature for about 4–5 hours. Analysis of the catalyst showed that it contained 0.2 weight percent sulfur.

The combined product obtained from the above treatment was divided into two equal portions. One portion was processed through the hydrogenolysis reactor a second time at a LHSV of 3.0 $hr^{-1}$, a pressure of 240 psig and a temperature of 210° C. The properties of the products from once and twice through the hydrogenolysis reactor are presented in Table 2 below.

TABLE 2

Comparison of Fresh and Hydrogenolysed Kerosines

| Parameter | Fresh Feed | Once Hydrogenolysed Product | Twice Hydrogenolysed Product |
|---|---|---|---|
| RSH-S, wppm | 413 | 426 | 165 |
| $H_2S$-S, wppm | NONE | 14 | 145 |
| APHA Color[a] | 110 | 57 | 3 |

[a]The APHA color scale begins at 0 for uncolored material. Thus low APHA numbers are preferred.

The data indicate that the mercaptan and hydrogen sulfide sulfur concentration after one hydrogenolysis treatment was greater than in the fresh feed. It is likely that some nonmercaptan compounds such as disulfides and thioethers were converted to mercaptans and hydrogen sulfide. However, it is observed that after two hydrogenolysis treatments the mercaptan level was drastically reduced and considerable hydrogen sulfide was produced. It is also observed that selective hydrogenolysis improves the color of the kerosine.

The fresh, once and twice hydrogenolysed kerosines were now treated by contacting them with a mercaptan oxidation catalyst as follows. The catalyst was placed in a reactor and the kerosine downflowed through it at a LHSV of 10 $hr^{-1}$. To the feed there were added, as an aqueous solution, 800 wppm of ammonia, and 20 wppm of alkyldimethylbenzyl ammonium hydroxide (both concentrations based on kerosine). The alkyl portion was a mixture of $C_{12}$ to $C_{16}$ straight chain alkanes. The process was carried out at a temperature of 38° C., a pressure of 100 psig and an oxygen (added as air) concentration of 2.0 times stoichiometry. The twice hydrogenolysed kerosine, however, had an oxygen concentration of 9.0 times stoichiometry to ensure oxidation of all the hydrogen sulfide.

The catalyst used in the above process was a cobalt phthalocyanine on a carbon support. The catalyst was prepared by simultaneously impregnating sulfonated cobalt phthalocyanine, CoPC, (obtained from GAF Co.), and quaternary ammonium chloride with the same alkyl group portion as described above onto granular activated carbon (obtained from Norit Co.). The impregnation was from an aqueous solution of the two chemicals. A steam-jacketed glass rotary impregnator was used to perform the impregnation. The charcoal and aqueous solution were rotated at room temperature for one hour after which time the steam was turned on and the water evaporated. The amounts of reagents used were calculated to provide 0.15 g CoPc and 4.5 g quaternary ammonium chloride per 100 cc of support.

Each kerosine feed was flowed through the reactor for a total of 85 hours. The product properties after 84 hours of operation are presented in Table 3.

TABLE 3

Effect of Selective Hydrogenolysis on the Oxidation of Mercaptans

| Parameter | Fresh Feed | Once Hydrogenolysed | Twice Hydrogenolysed |
|---|---|---|---|
| Initial Mercaptan Conc. (wppm) | 413 | 426 | 165 |
| Mercaptan Concentration after Oxidation* | 162 | 110 | 55 |
| Percent Mercaptan Conversion | 60.8 | 74.2 | 66.7 |
| Total Mercaptan Conversion (Hydrogenolysis + Oxidation) | — | 73.4 | 86.7 |
| APHA Color* | 220 | 112 | 5 |

*Analysis carried out after 84 hours of onstream operation

The data presented in Table 3 indicate that the mercaptans which remain after hydrogenolysis are easier to oxidize as evidenced by comparing the mercaptan sulfur concentration after oxidation of the fresh feed (162 ppm) versus the once hydrogenolysed feed (110 ppm) and the twice hydrogenolysed feed (55 ppm). Finally, the color of the kerosine after an oxidative treatment is better if the feed was first hydrogenolysed.

EXAMPLE 2

Another series of experiments were performed with a kerosine having 737 ppm of mercaptan sulfur, no hydrogen sulfide and an APHA of 15. The kerosine was first hydrogenolysed as in Example 1 except that the LHSV was 3 $hr^{-1}$, the hydrogen pressure was 240 psig and the temperature was 210° C. The hydrogenolysed product was treated to oxidize the mercaptans using the procedure in Example 1 except that 1.5 times the stoichiometric amount of oxygen was used. Prior to oxidatively treating the hydrogenolysed product, it was flowed through a 4A molecular sieve bed to remove the hydrogen sulfide produced by the hydrogenolysis. A sample of the fresh kerosine feed was also oxidatively treated as described above except that the LHSV was 0.5 $hr^{-1}$ instead of 1.0. The properties of these kerosines after each treatment are presented in Table 4.

TABLE 4

Effect of Hydrogenolysis on Mercaptan Oxidation

| Kerosine I.D. | Mercaptan Conc. (wppm) | APHA Color |
|---|---|---|
| Fresh | 737 | 15 |
| Once Hydrogenolysed | 159 | 0 |
| Fresh, then Oxidatively Treated[1] | 24 | 700 |
| Once Hydrogenolysed, then Oxidatively Treated[1] | 0 | 105 |
| Fresh, then Oxidatively Treated | 24 | 700 |
| Once Hydrogenolysed, then Oxidatively Treated | 0 | 105 |

[1]Analyses obtained after 42 hours of onstream oxidation.

The data clearly show that combining hydrogenolysis with an oxidation step sweetens the kerosine whereas an oxidation step alone gives a product that still contains considerable amounts of mercaptans. Also the hydrogenolysis step minimizes the color degradation of the product kerosine after the oxidation step.

EXAMPLE 3

A second sample of the fresh kerosine used in Example 2 was hydrogenolysed as per Example 2. After treatment through the 4A sieves to remove hydrogen sulfide, the kerosine contained 194 wppm of mercaptan sulfur. This product was now treated to oxidize the mercaptans using the same reactor and a fresh sample of catalyst as in Example 1. The oxidation was carried out at a temperature of 38° C., a pressure of 100 psig and a LHSV of 1.0 $hr^{-1}$. The other parameters were varied and the results of these experiments are presented in Table 5.

TABLE 5

Effect of Oxidation Conditions on the Conversion of Mercaptans for a Hydrogenolysed Kerosine Feed.

| Mercaptan Conc. (wppm) | $NH_3$ (wppm) | $O_2$* | Quat[1] (wppm) |
|---|---|---|---|
| 145 | 400 | — | 40 |
| 0 | 400 | 1.5 | 40 |
| 0 | 100 | 1.5 | 40 |
| 3 | 100 | 1.0 | 40 |
| 72 | 100 | — | 40 |

*Amount of added oxygen as a multiple of the stoichiometric amount.
[1]The quaternary ammonium chloride salt used was the same as in Example 2.

These data clearly indicate that sweetening of a hydrogenolysed kerosine can be obtained at low ammonia concentrations and oxygen concentrations.

EXAMPLE 4

A third kerosine containing 581 wppm mercaptan sulfur and an APHA of 43 was hydrogenolysed at 210° C., LHSV of 3.0 $hr^{-1}$ and a pressure of 240 psig using the catalyst of Example 1. The product was flowed through 4A sieves to give a kerosine with 391 wppm mercaptan sulfur.

This hydrogenolysed kerosine was treated with the same oxidation catalyst as Example 1 under the following conditions: $NH_3$=50 wppm; quaternary ammonium chloride (same as Example 1)=40 wppm; $O_2$=1.0 stoichiometry; temperature=38° C.; pressure=100 psig. The product obtained from this treatment had a mercaptan sulfur concentration of 3 wppm.

What this experiment shows is that even though the mercaptan concentration did not decrease as much after hydrogenolysis as in previous experiments, effective sweetening was still obtained after the oxidation treatment.

EXAMPLE 5

A fresh batch of the kerosine used in Example 2 was first hydrogenolysed under similar conditions as those described in Example 2. Two products were obtained: Product X which contained 170 wppm mercaptan and Product Y which contained 75 wppm of mercaptan.

The fresh feed and hydrogenolysed products X and Y were treated to oxidize the mercaptans as follows. Each sample was put into a stirred contactor which consisted of a cylindrical glass container measuring 3.5 inches in diameter by 6 inches high and which contained 4 baffles that are at 90° angles to the side walls was used. An air driven motor was used to power a paddle stirrer positioned in the center of the apparatus. When turning, the stirrer paddles passed within ½" of the baffles. This resulted in a very efficient, pure type of mixing.

To the above apparatus there were added 300 mL of the kerosine to be treated, 50 mL of an aqueous 8 weight percent sodium hydroxide solution and 0.05 g of tetrasulfonated cobalt phthalocyanine. Periodically samples were removed and analyzed for mercaptan sulfur. The results of these experiments are presented in Table 6.

TABLE 6

Hydrogenolysis and Liquid/Liquid Treatment of Kerosines

| | Mercaptan Concentration (wppm) | | |
|---|---|---|---|
| Time (mins) | Untreated | Sample X | Sample Y |
| 0 | 737 | 170 | 75 |
| 2 | 280 | 55 | 40 |
| 6 | 190 | 51 | 35 |
| 13 | 160 | 42 | 35 |
| 28 | 110 | 30 | 20 |
| 53 | 70 | 20 | 5 |

The results presented above show that a kerosine feed that has not been hydrogenolysed is not sweetened using a liquid/liquid process, but the two hydrogenolysed samples are sweetened.

We claim as our invention:

1. A process for sweetening a sour hydrocarbon fraction comprising:
   (a) reacting mercaptans contained in the sour hydrocarbon fraction with hydrogen in the presence of a selective hydrogenolysis catalyst at hydrogenolysis conditions and for a time sufficient to selectively hydrogenolyse the tertiary mercaptans; and
   (b) reacting the mercaptans in the sour hydrocarbon fraction with an oxidizing agent in the presence of a basic component and an oxidation catalyst effective in oxidizing the mercaptans to disulfides;

the steps (a) and (b) carried out in any order to produce a sweetened hydrocarbon fraction.

2. The process of claim 1 where the selective hydrogenolysis step is carried out before the oxidation step.

3. The process of claim 1 where the oxidation step is carried out before the selective hydrogenolysis step.

4. The process of claim 1 where the hydrogenolysis catalyst comprises at least one metal dispersed on a porous support, the porous support selected from the group consisting of alumina, silica, carbon, alumina-silicates, natural and synthetic clays, alkaline earth oxides, and mixtures thereof, the metal selected from the group consisting of a Group VIII metal, a Group VIB metal and mixtures thereof.

5. The process of claim 4 where the hydrogenolysis catalyst is nickel dispersed on a support which is a mixture of a clay and alumina, the nickel present in an amount from about 0.5 to about 15 weight percent.

6. The process of claim 1 where the reaction conditions are a temperature of about 25° C. to about 300° C., a pressure of about 100 to about 1000 psig and a hydrogen concentration of about 0.1 to about 10 mole percent based on the total mercaptan sulfur concentration.

7. The process of claim 1 where the oxidation catalyst is a metal chelate dispersed on an adsorbent support.

8. The process of claim 7 where the metal chelate is a metal phthalocyanine.

9. The process of claim 8 where the metal phthalocyanine is cobalt phthalocyanine.

10. The process of claim 1 where the basic component is selected from the group consisting of ammonium hydroxide, alkali metal hydroxides and mixtures thereof.

11. The process of claim 10 where the basic component is ammonium hydroxide.

12. The process of claim 1 where the oxidation step is carried out in the presence of an onium compound.

13. The process of claim 12 where the onium compound is selected from the group consisting of quaternary ammonium, phosphonium, arsonium, stibonium, oxonium, and sulfonium compounds having the formula $$[R'R''R_yM]^+X^-$$

where R is a hydrocarbon group containing up to about 20 carbon atoms and selected from the group consisting of alkyl, cycloalkyl, aryl, alkaryl, and aralkyl, R′ is a straight chain alkyl group containing from about 5 to about 20 carbon atoms, R″ is a hydrocarbon group selected from the group consisting of aryl, alkaryl and aralkyl, M is nitrogen, phosphorus, arsenic, antimony, oxygen or sulfur, and X is an anion selected from the group consisting of halide, hydroxide, nitrate, sulfate, phosphate, acetate, citrate and tartrate, and y is 1 when M is oxygen or sulfur and y is 2 when M is phosphorus, arsenic, antimony or nitrogen.

14. The process of claim 13 where the onium compound is a quaternary ammonium compound.

15. The process of claim 1 where the oxidation catalyst also contains an onium compound.

16. The process of claim 1 where the oxidation catalyst is a metal chelate which is dissolved in an aqueous solution containing a basic component.

* * * * *